US007334579B2

(12) United States Patent
Tayebi

(10) Patent No.: US 7,334,579 B2
(45) Date of Patent: Feb. 26, 2008

(54) LOW RESISTANCE TO FLOW FILTER

(76) Inventor: Amad Tayebi, 5 Sequoia Rd., Westford, MA (US) 01886

( * ) Notice: Subject to any disclaimer, the term of this patent is extended or adjusted under 35 U.S.C. 154(b) by 800 days.

(21) Appl. No.: 10/848,292

(22) Filed: May 18, 2004

(65) Prior Publication Data

US 2004/0211424 A1 Oct. 28, 2004

Related U.S. Application Data

(63) Continuation-in-part of application No. 10/228,402, filed on Aug. 27, 2002, now Pat. No. 6,736,138.

(60) Provisional application No. 60/315,187, filed on Nov. 10, 2001.

(51) Int. Cl.
*A62B 7/10* (2006.01)
*A62B 23/02* (2006.01)

(52) U.S. Cl. ..... 128/205.27; 128/206.16; 128/206.17

(58) Field of Classification Search ..... 128/200.24, 128/205.27, 206.12, 206.19, 206.16, 206.17
See application file for complete search history.

(56) References Cited

U.S. PATENT DOCUMENTS 4,886,058 A * 12/1989 Brostrom et al. ..... 128/206.12
5,035,236 A * 7/1991 Kanegaonkar ..... 128/201.13
5,240,479 A * 8/1993 Bachinski ..... 96/17
6,161,540 A * 12/2000 Fecteau ..... 128/205.27
6,309,438 B1 * 10/2001 Kanno et al. ..... 55/486
6,345,620 B2 * 2/2002 Salapow et al. ..... 128/206.17

* cited by examiner

*Primary Examiner*—Michael J. Hayes
*Assistant Examiner*—Michael G. Mendoza

(57) ABSTRACT

The present invention discloses a seamless pad-type filter which is characterized in that it comprises two co-extensive sides, a top side and a bottom side. The top and bottom sides are made of fluid filtration material. The two sides create an inner chamber therebetween and are surrounded and joined together by a seamless outer perimeter. The seamless outer perimeter providing a seamless folded continuity between the two sides of the pad-type filter in the form of a plurality of fold lines which, as connecting segments beginning and ending at the same point, define the seamless outer perimeter. The top side further comprising a plurality of positive and negative secondary creases formed around a plurality of positive and negative crease lines. The crease lines are inclined to the fold lines and form pleats. The pleats are sealed to form a primary flow aperture such that a fluid passing through said primary flow aperture passes only through at least one of the bottom side, the top side and the seamless outer perimeter.

1 Claim, 17 Drawing Sheets

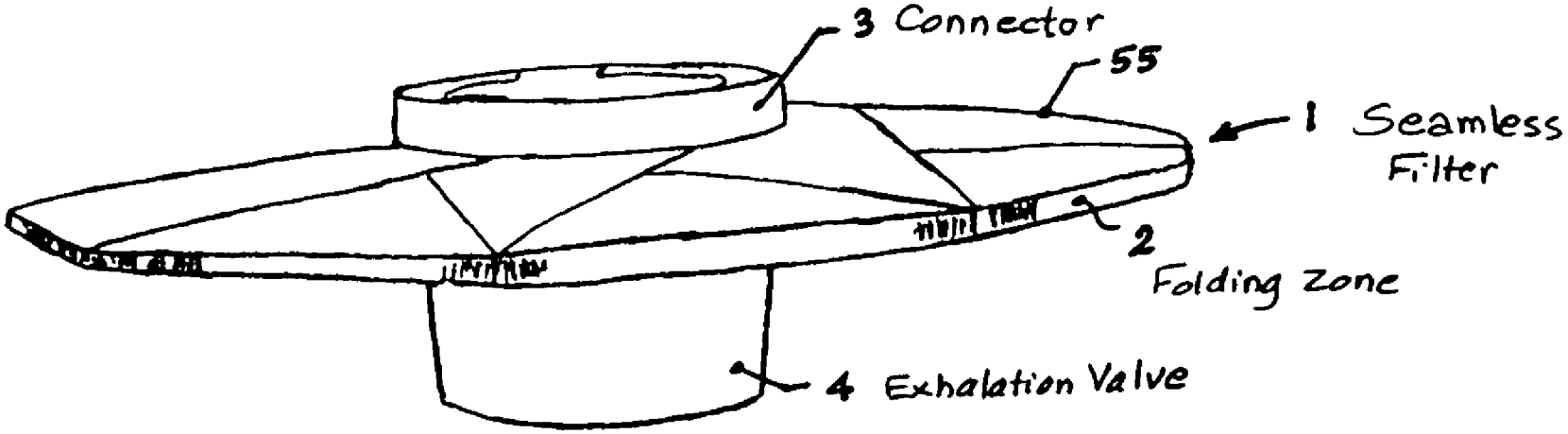
Figure (1)

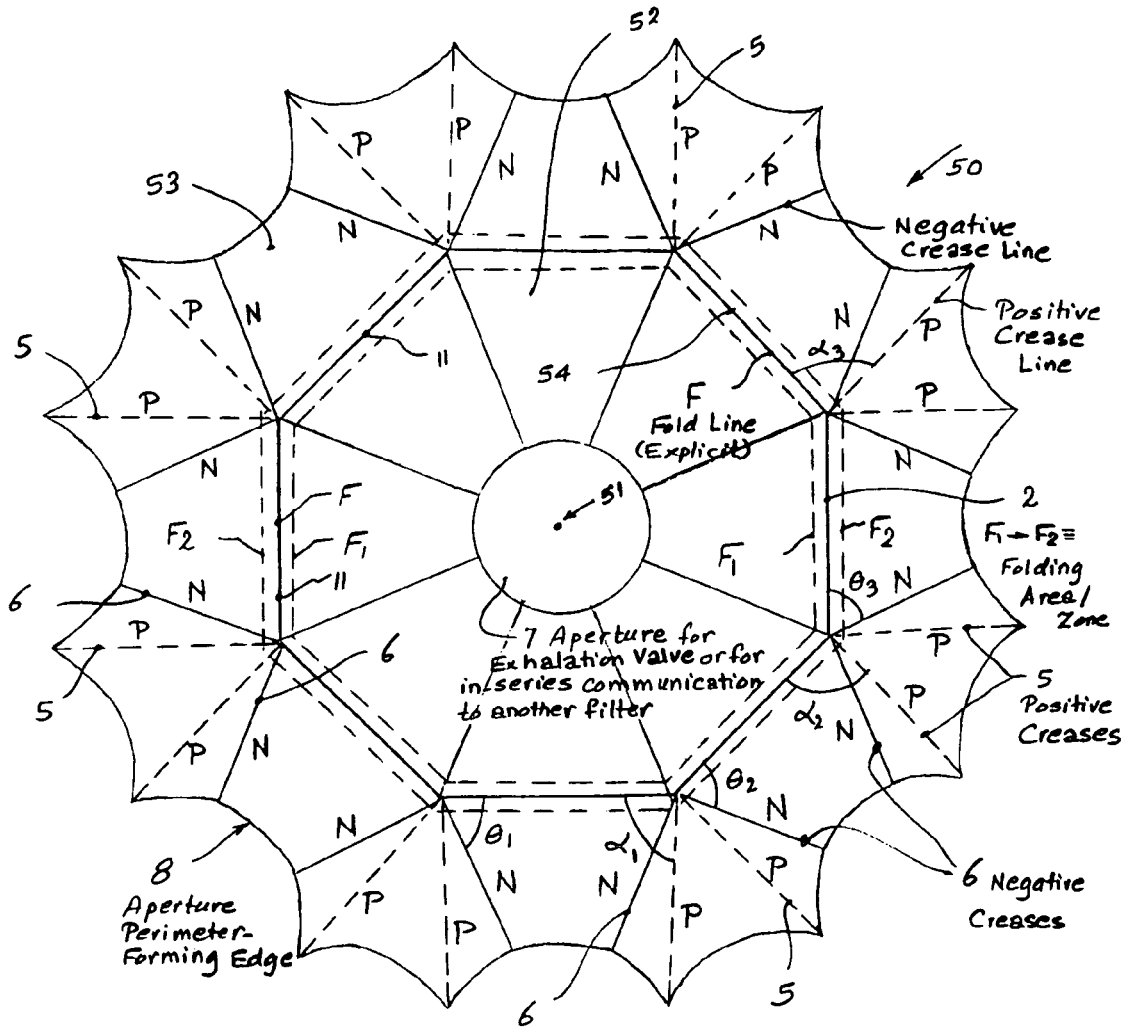
Figure (2)

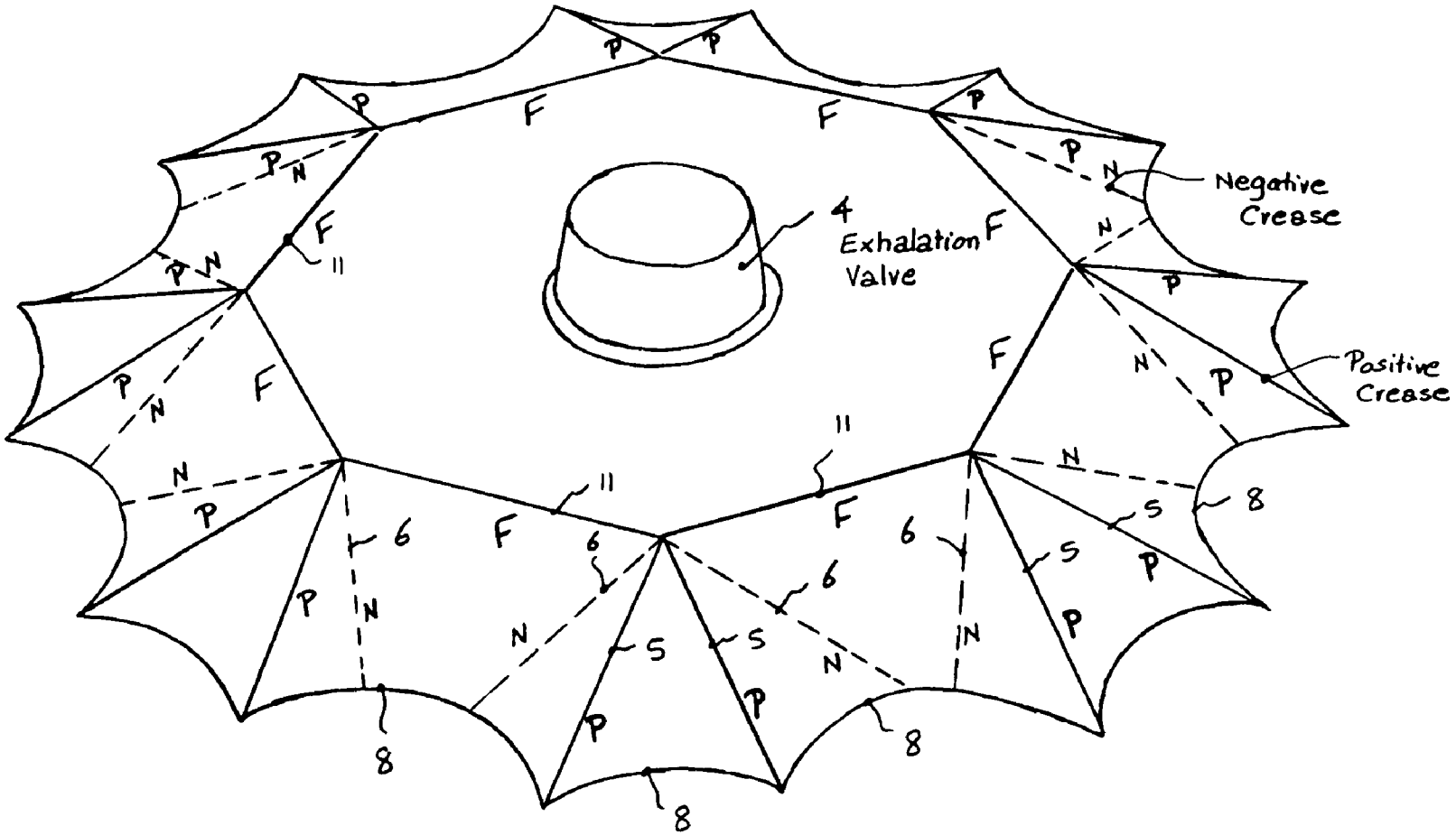
Figure (3)

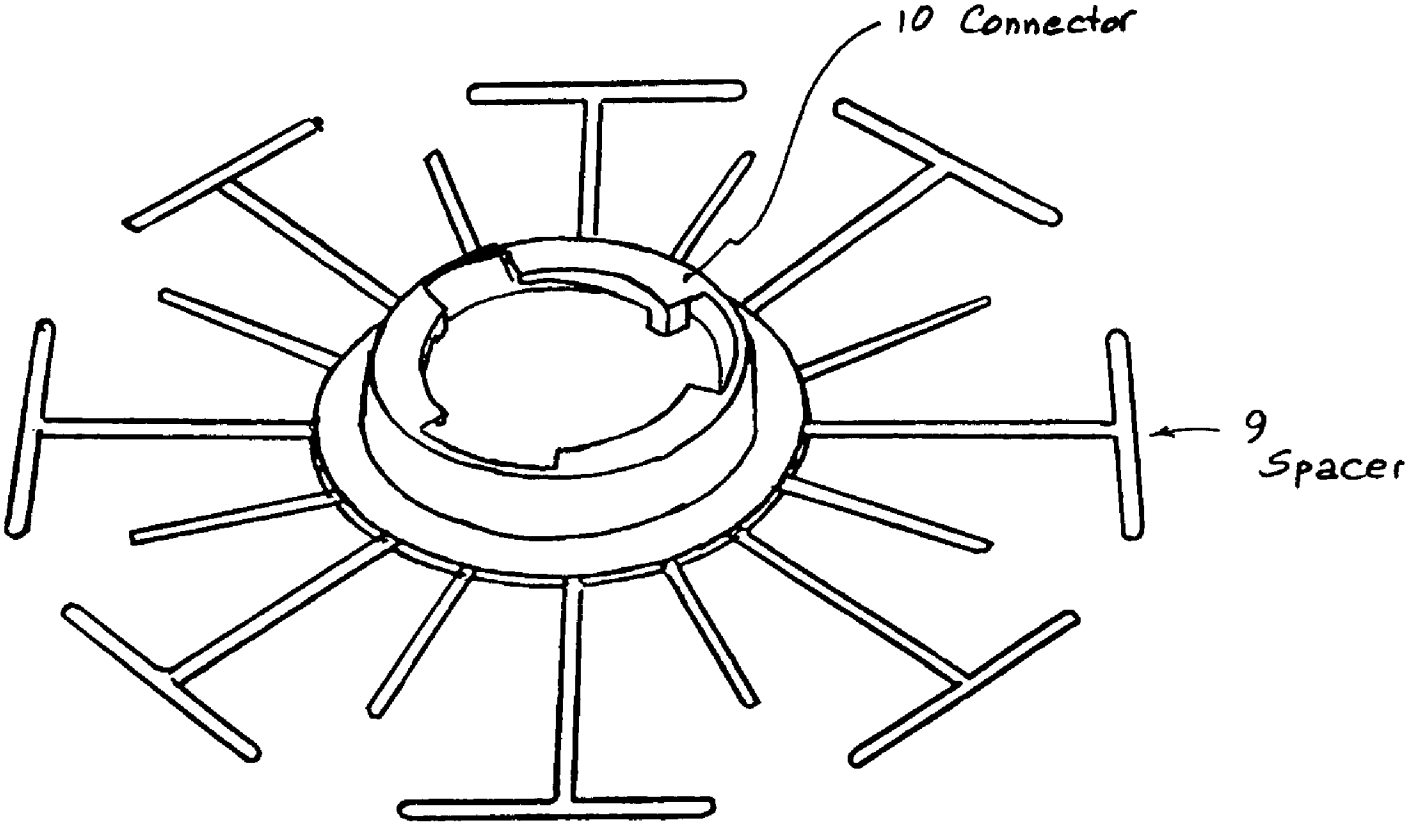
Figure (4)

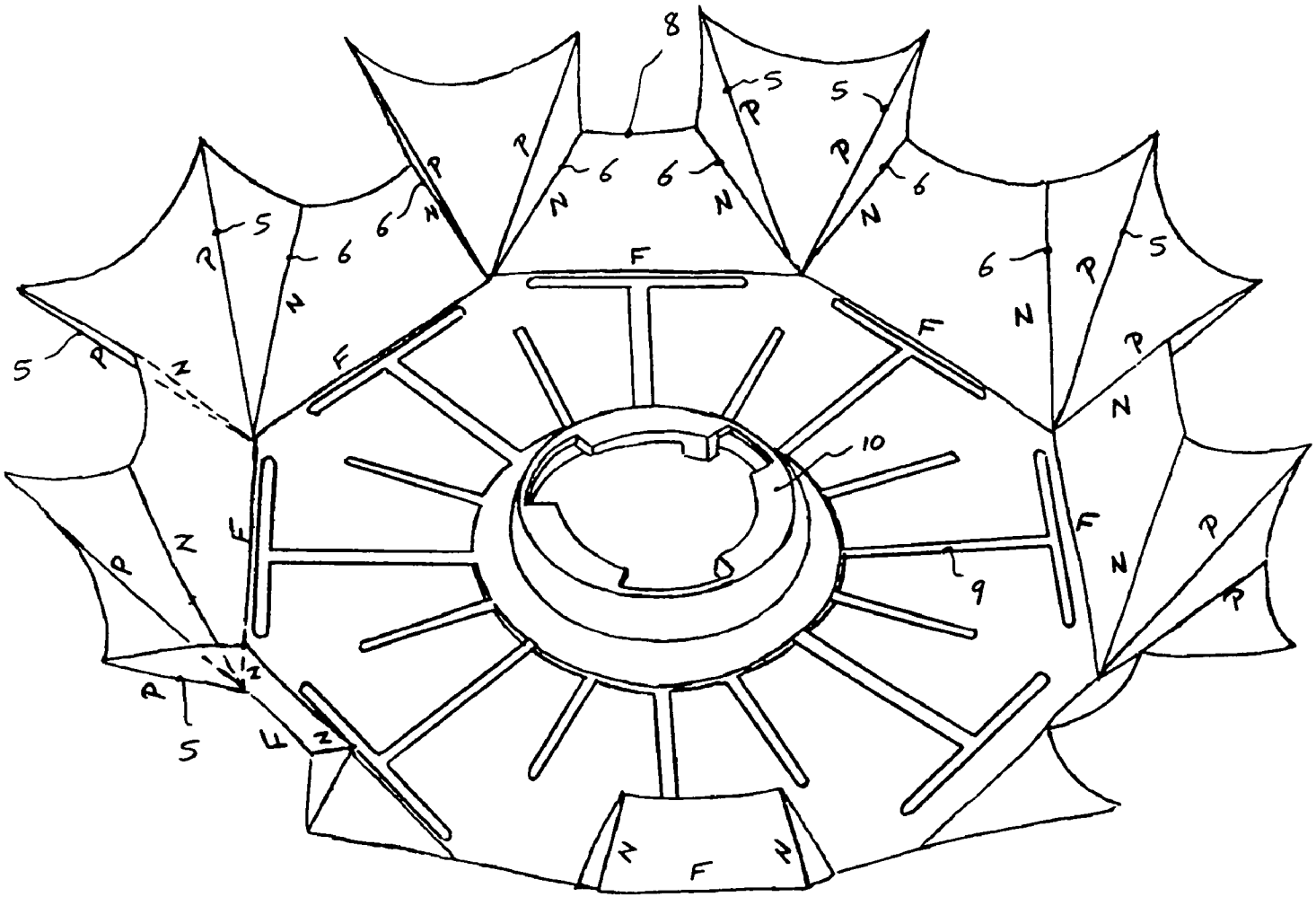
Figure (5)

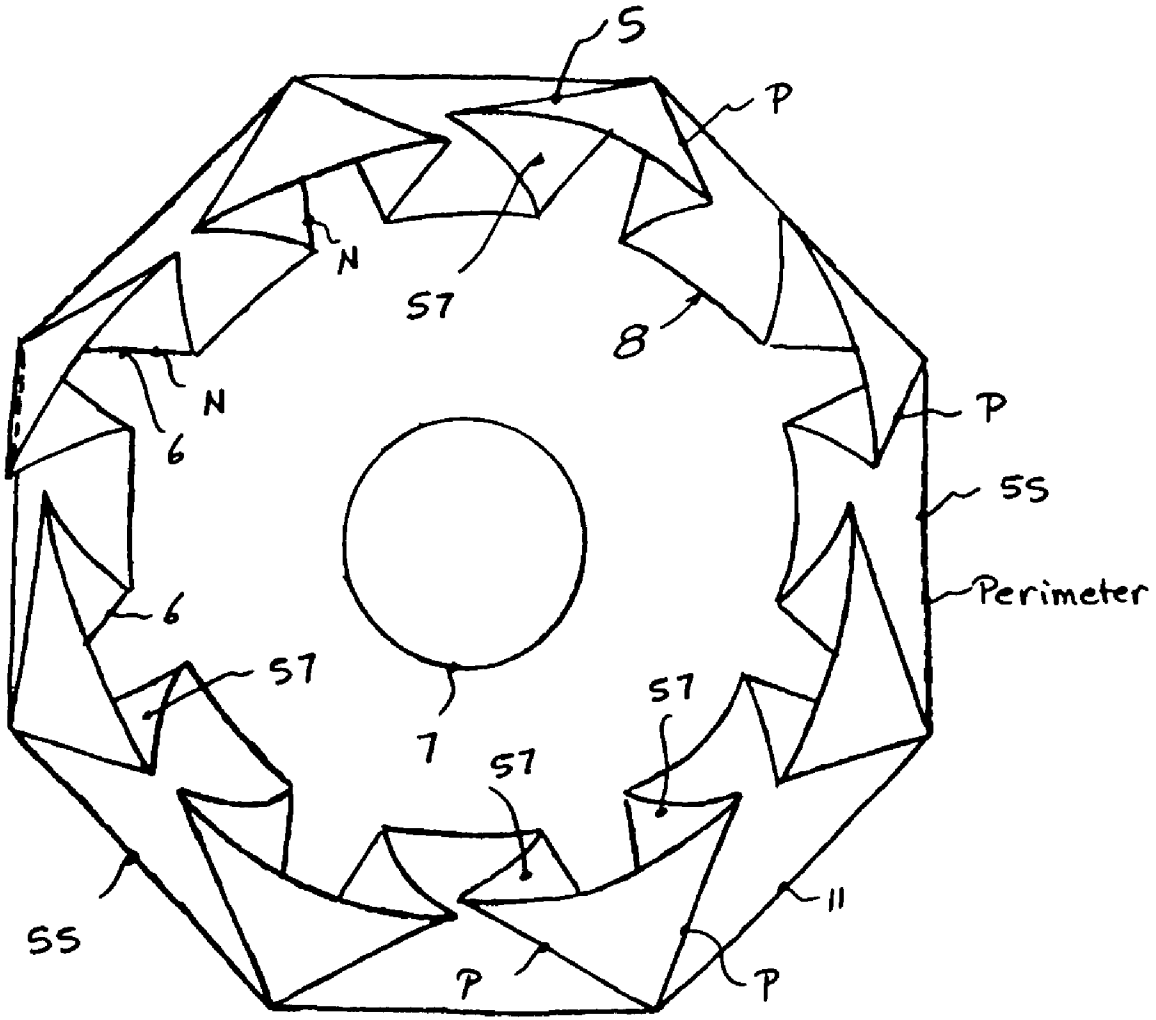
Figure (6)

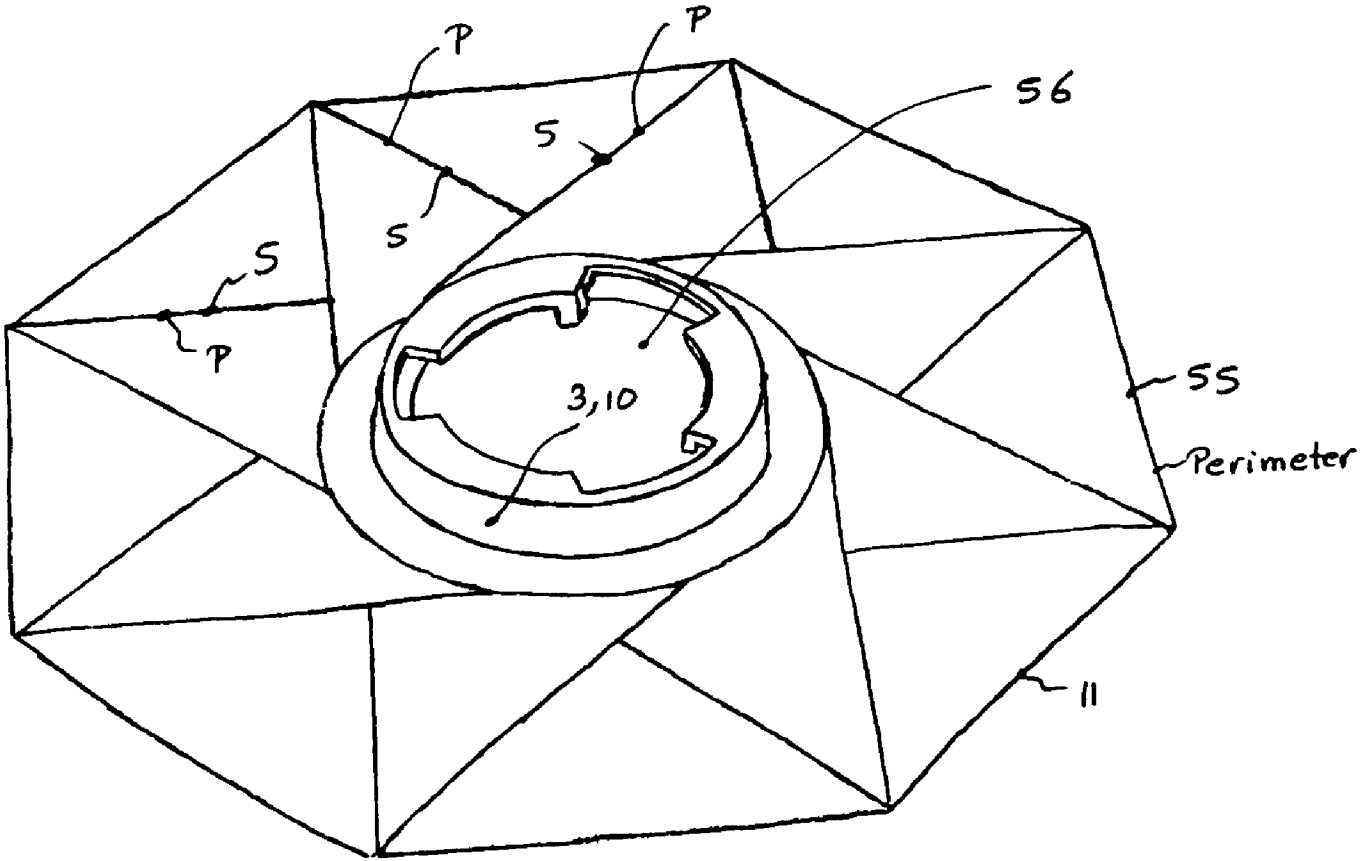
Figure (7)

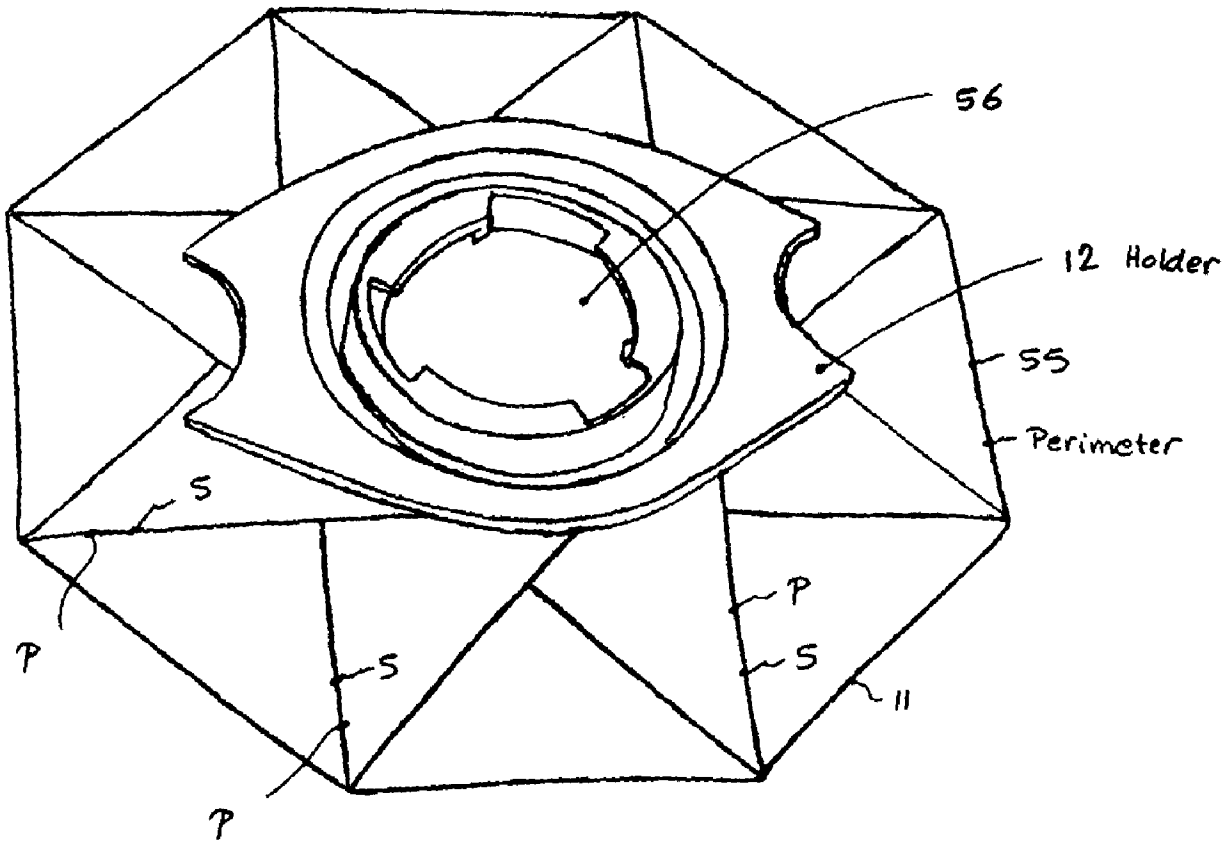
Figure (8)

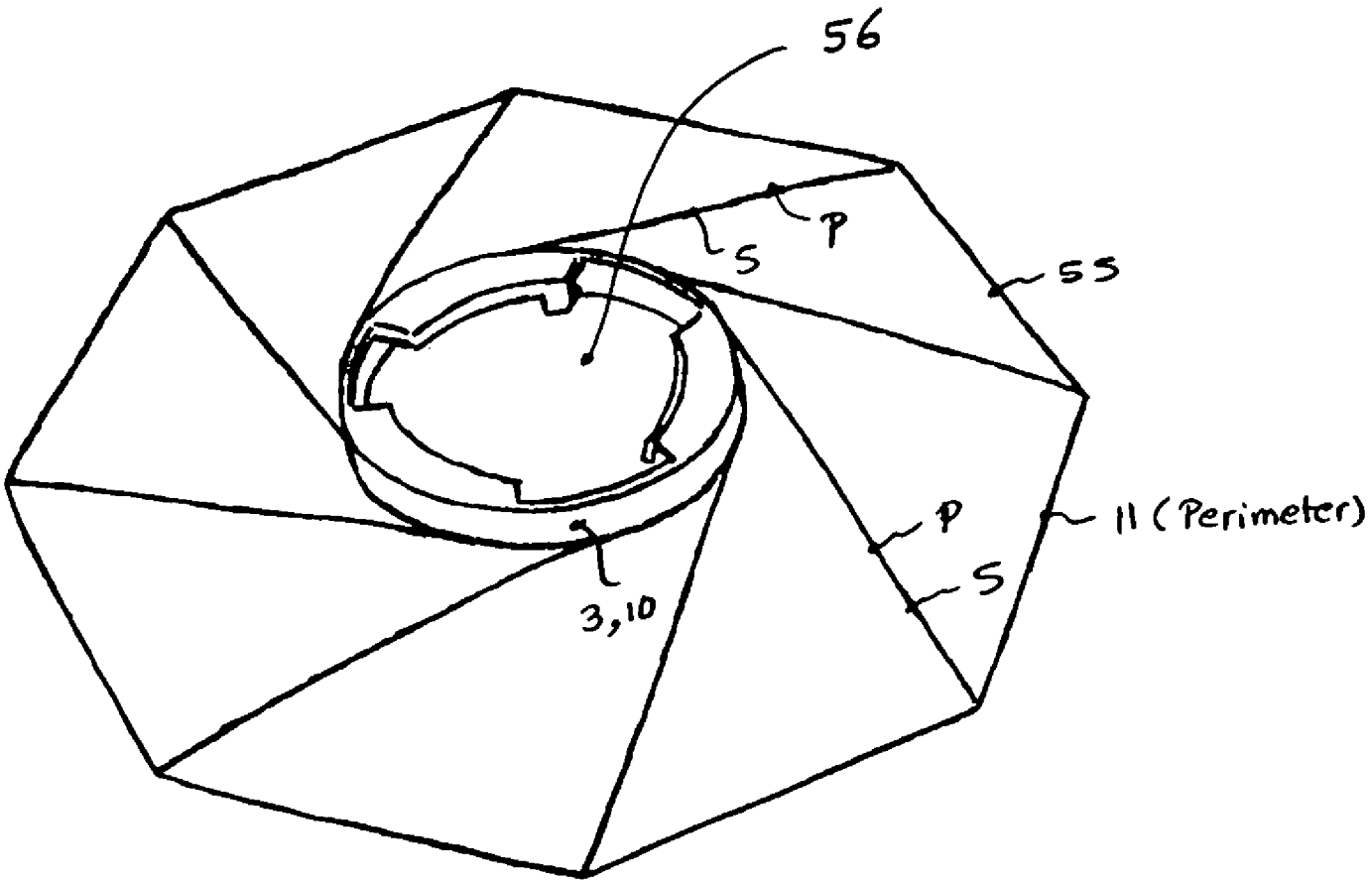
Figure (9)

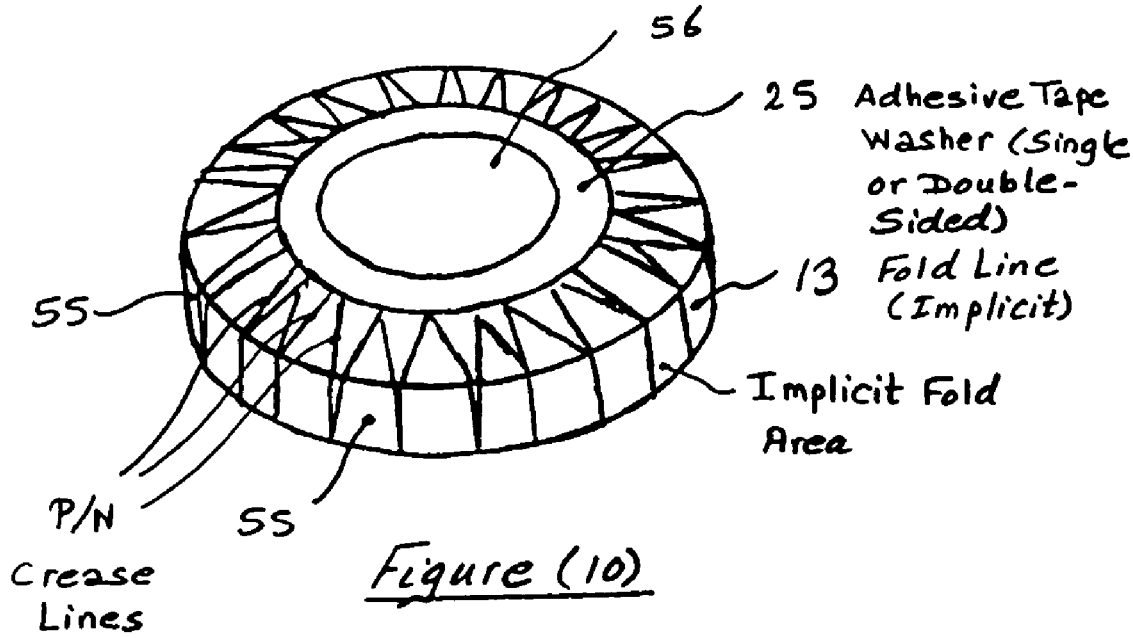
Figure (10)

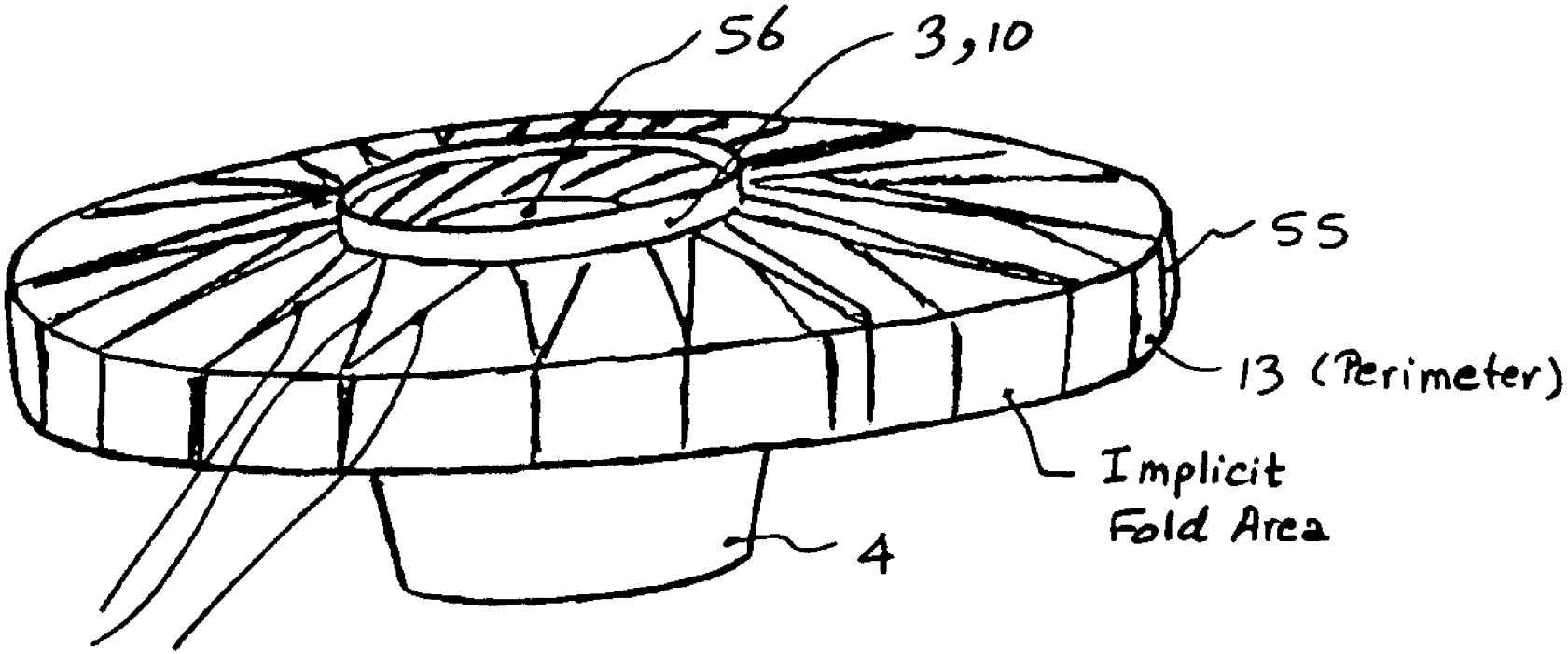
Figure (11)

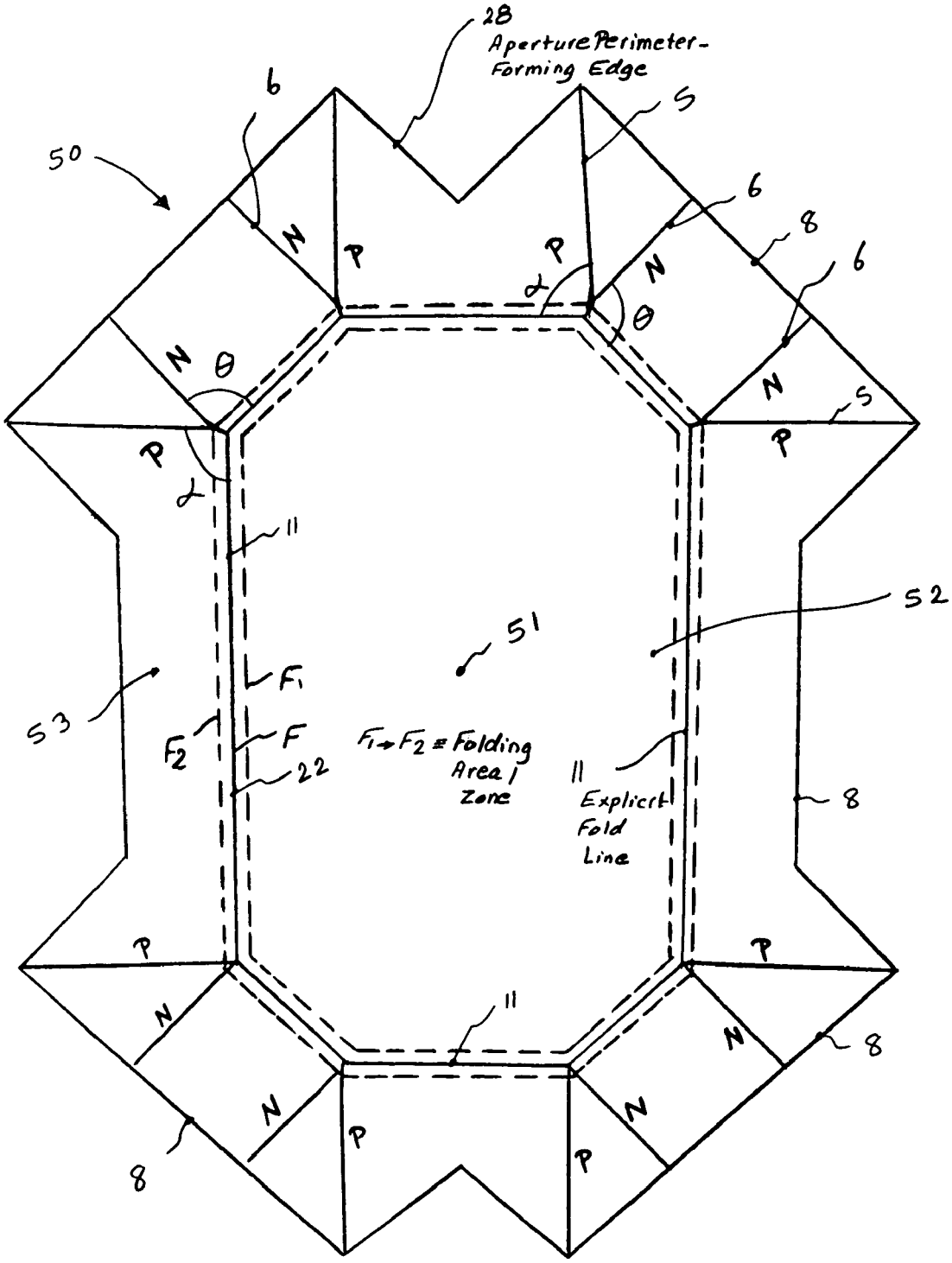
Figure (12)

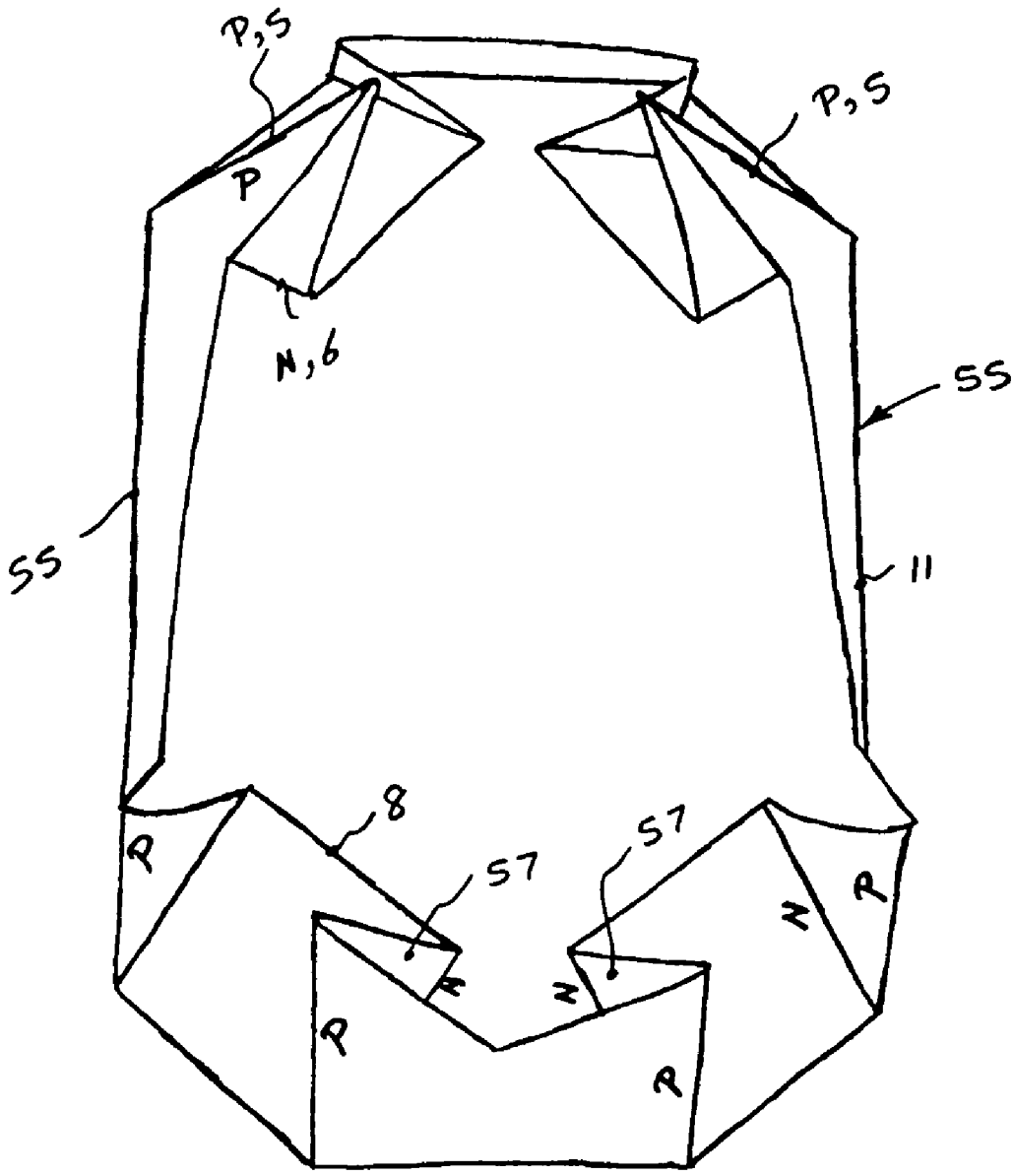
Figure (13)

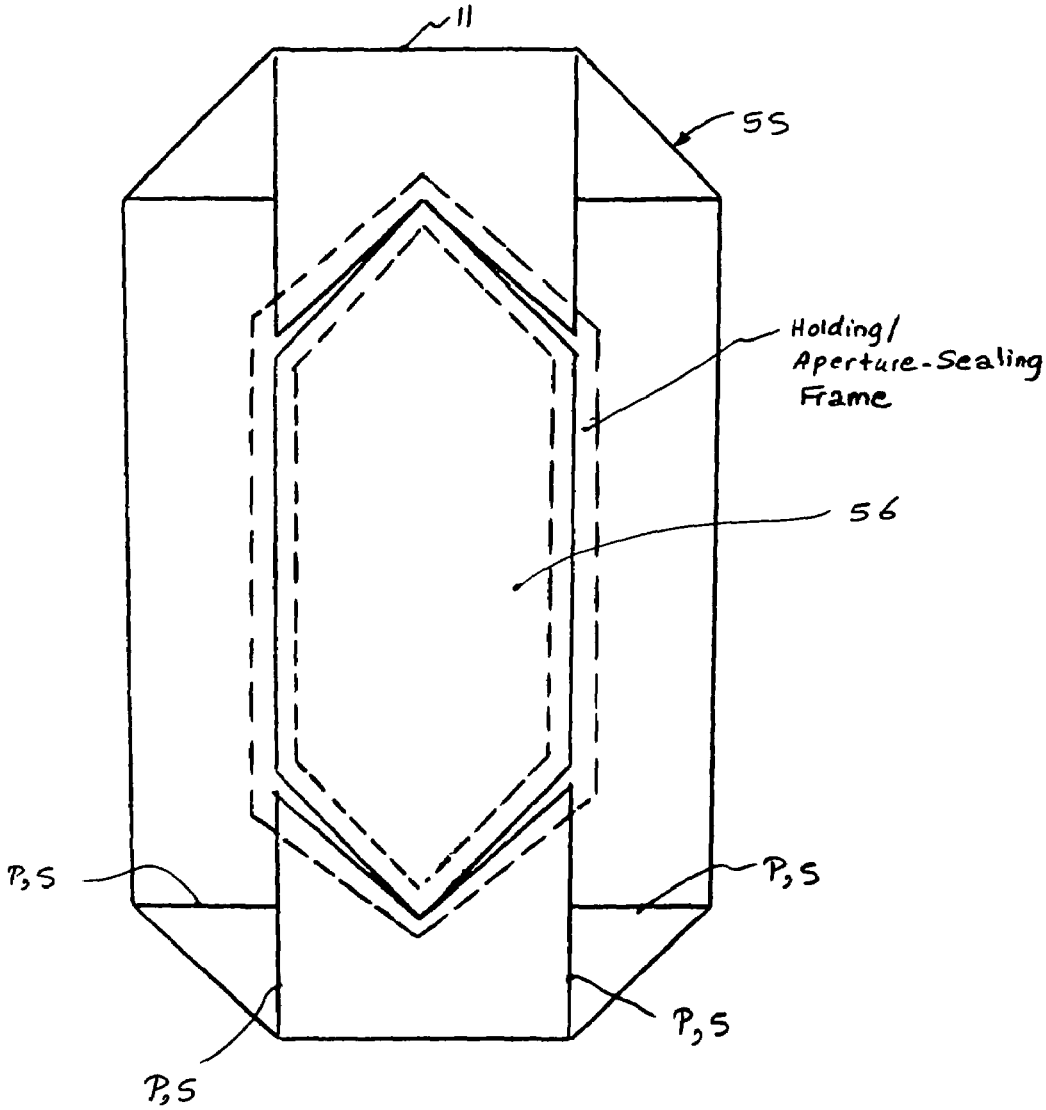
Figure (14)

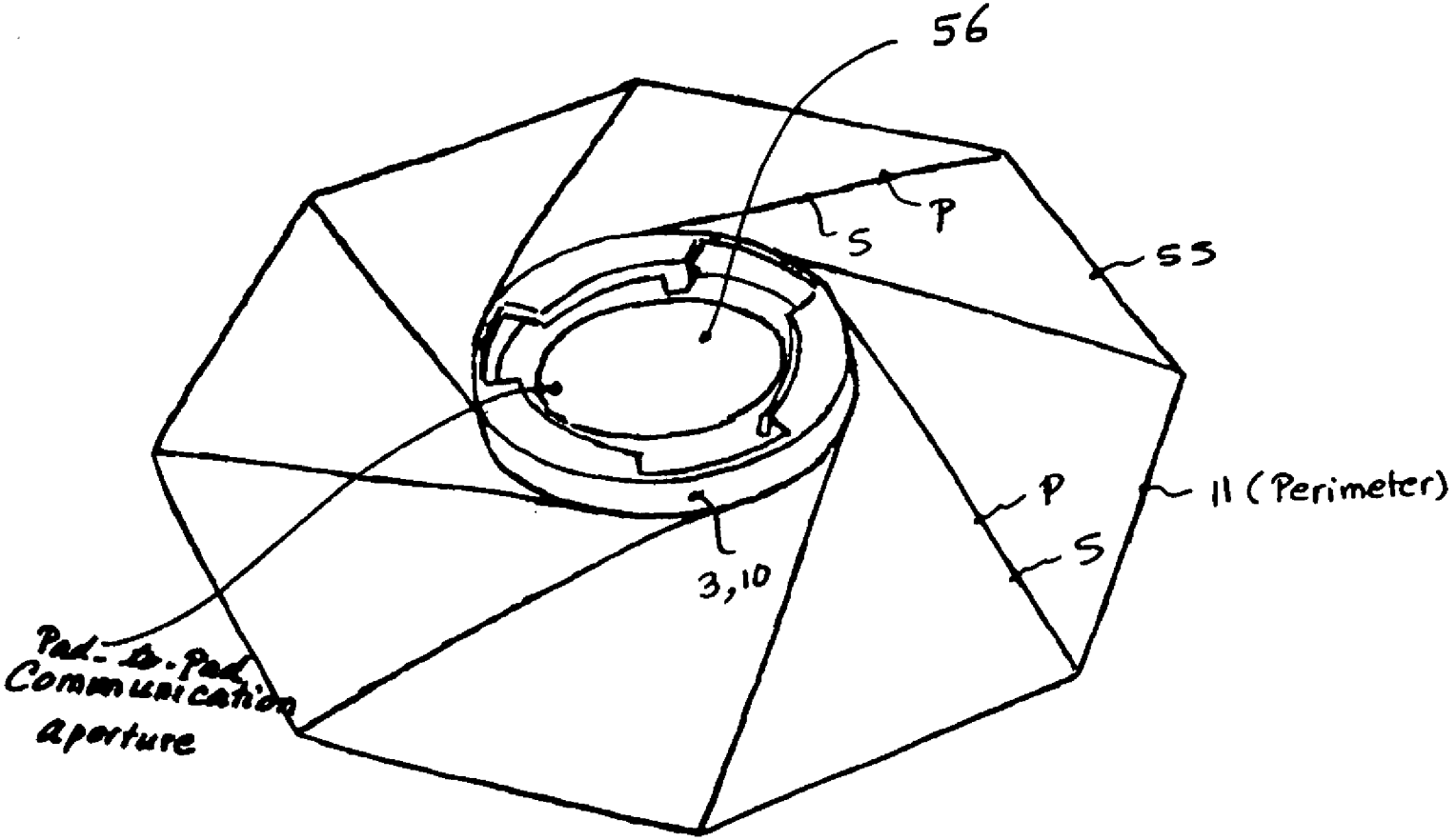
Figure (15)

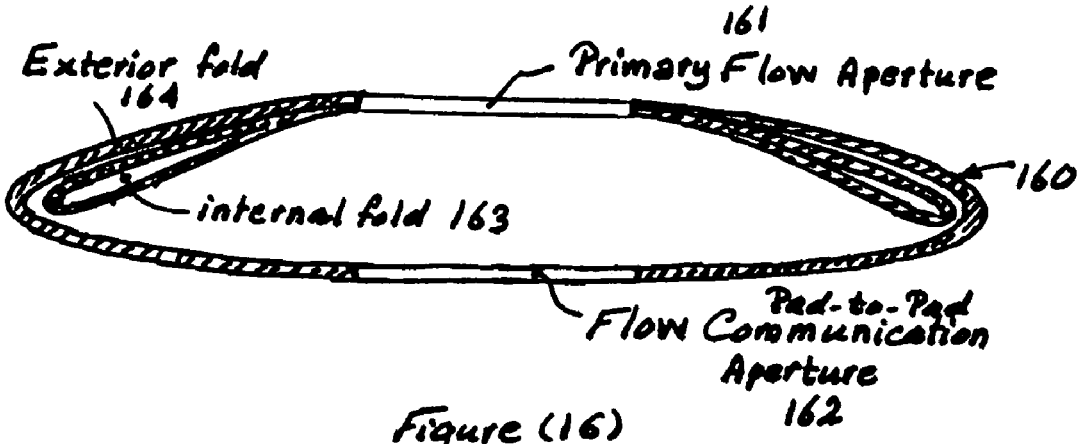
Figure (16)

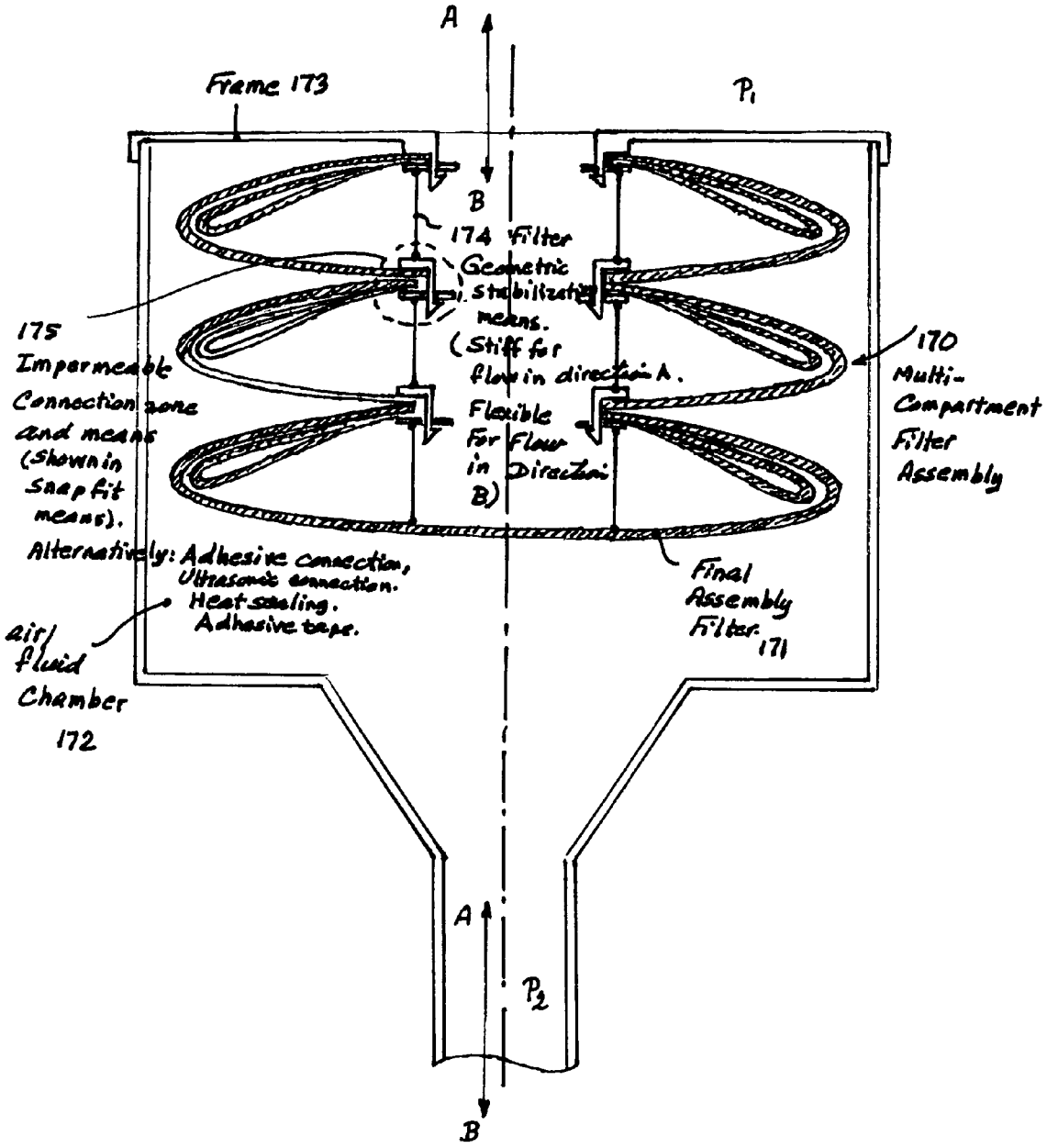
Figure (17)

LOW RESISTANCE TO FLOW FILTER

This application is a continuation in part of application Ser. No. 10/228,402 filed Aug. 27, 2002 which is issuing on May 18, 2004 as U.S. Pat. No. 6,736,138 and which is incorporated, in its entirety, in this application. This application also claims a priority date of Provisional Patent Application No. 60/315,187, filed on Nov. 10, 2001, which is hereby incorporated by reference in this application.

FIELD

The present invention is in the field of fluid-purifying filters. In particular it teaches a seamless pad-type fluid purifying filter and a method for its manufacture.

BACKGROUND

The prior art teaches a variety of structures of pad-type filters and methods for their manufacture. Examples of such teachings are disclosed in U.S. Pat. No. Re: 35,062 (a 1995 reissue of U.S. Pat. No. 4,886,058, issued on Dec. 12, 1989), U.S. Pat. Nos. 6,345,620 and 5,992,414, all of which are incorporated in this application by reference. In addition, U.S. Pat. No. 6,309,438 which teaches a "filter unit and dust-proof mask therewith" and discloses highly efficient filtration media, such as biaxially expanded polytetrafluoroethylene porous films, is also incorporated in this application by reference.

In accordance with the present invention, a pad-type filter is defined as a filter comprising at least two layers of filtration media hermetically sealed to one another along a common perimeter and separated from one another by an inner chamber created therebetween and at least one opening in at least one of the layers such that a fluid passing through said opening passes only through at least one of the two layers. A pad-type filter thus offers a larger surface area for fluid flow than the projected area of the filter and, therefore, exhibits a lower overall resistance to flow at the same volume flow rate through the same filtration media than single layer filters having the same projected area. A significant disadvantage, however, of all pad-type filters of the prior art is that the sealed area adjacent to and around the common perimeter is highly compacted and inefficiently, if at all, utilized. Thus, such pad-type filters still suffer severe limitations on their filtration efficiency, resistance to flow and filtration material utilization efficiency. The seamless pad-type filter of the present invention overcomes the problems associated with prior art pad-type filters. In addition, the present invention provides, at more efficient material utilization and lower material and assembly costs, a method for manufacture of seamless pad-type filters. The pad-type filter of the present invention is characterized in that it eliminates the need for having to make a seal between the two sides of the filter along their common perimeter, as necessitated in the prior art.

DESCRIPTION OF THE INVENTION

The method of making the seamless pad-type filter of the present invention is shown in FIGS. 1 to 14. It comprises the steps of:

i) Providing a sheet of fluid filtration media 50, as shown in FIGS. 2 and 12. As shown therein, the sheet of filtration media 50 has an upper (also referred to as an inner) surface and a lower (also referred to as an outer) surface and comprises a center point 51, a central zone 52, a shaped perimeter 8 and an intermediate zone 53. Center point 51 is located within central zone 52 and central zone 52 is located within intermediate zone 53. Shaped perimeter 8 defines the outer edge of the sheet of filtration media 50. A folding zone 54 surrounds central zone 52 and is surrounded by intermediate zone 53.

ii) Forming a plurality of primary folds within said folding zone 54. Each primary fold is formed around an axis the projection of which lies within said folding zone 54 and forms a fold line which is spaced apart from center point 51. The plurality of primary folds, so formed, a) creates a plurality of fold lines 11 which, as connecting segments beginning and ending at the same point, define formed pad-type filter outer perimeter 55 and b) forms a plurality of positive and negative secondary creases 5 and 6. A positive secondary crease causes inner surface segments of the sheet of filtration media to face one another in the creased state and a negative secondary crease causes outer surface segments of the sheet of filtration media to face one another in the creased state. Secondary creases 5 and 6 are formed around a plurality of positive and negative crease lines P and N, respectively. Crease lines P and N are inclined (i.e., non parallel) to the fold lines 11 at angles $\alpha^s$ and $\theta^s$ respectively. In so forming a plurality of fold lines 11, defining formed filter outer perimeter 55 and forming pluralities of positive and negative crease lines P and N, shaped perimeter 8 of the sheet of filtration media 50 is pleated into pleats 57, as shown in FIGS. 6 and 13 that form a primary flow aperture 56, as shown in FIGS. 7, 8, 9, 10, 11 and 14, and iii) sealing pleats 57 so formed such that a fluid passing through primary flow aperture 56 passes only through at least one of central zone 52, intermediate zone 53 and folding zone 54.

The seamless pad-type filter of the present invention is characterized in that it comprises two co-extensive sides, a top side and a bottom side. The top and bottom sides are made of fluid filtration material. The two sides create an inner chamber therebetween and are surrounded and joined together by a seamless outer perimeter. The seamless outer perimeter providing a seamless folded continuity between the two sides of the pad-type filter in the form of a plurality of fold lines which, as connecting segments beginning and ending at the same point, define the seamless outer perimeter. The top side further comprising a plurality of positive and negative secondary creases formed around a plurality of positive and negative crease lines. The crease lines are inclined to the fold lines and form pleats. The pleats are sealed to form a primary flow aperture such that a fluid passing through said primary flow aperture passes only through at least one of the bottom side, the top side and the seamless perimeter.

BRIEF DESCRIPTION OF THE DRAWING

FIG. 1 is a perspective view of seamless filter.

FIG. 2 is a plan view of shaped perimeter filtration media.

FIG. 3 shows a sheet of filtration media during progressive folding.

FIG. 4 shows an internal connector and spacer.

FIG. 5 shows a sheet of filtration media during progressive folding around connector and spacer combination.

FIG. 6 shows a sheet of filtration media during progressive folding and forming pleats.

FIG. 7 is a perspective view of seamless filter assembly.

FIG. 8 is a perspective view of seamless filter assembly.

FIG. 9 is a perspective view of seamless filter assembly.

FIG. 10 is a perspective view of seamless filter assembly featuring implicit fold area and randomly generated fold and crease lines.

FIG. 11 is a perspective view of seamless filter assembly featuring implicit fold area and randomly generated fold and crease lines.

FIG. 12 is a plan view of shaped-perimeter filtration media.

FIG. 13 shows a sheet of filtration media during progressive folding and forming pleats.

FIG. 14 is a top view of seamless filter assembly.

FIG. 15 is a top view of seamless filter assembly featuring a seamless pad filter to seamless pad filter communication aperture.

FIG. 16 is a cross sectional view of seamless pad filter shown in FIG. 15.

FIG. 17 shows a low resistance to flow filter comprising an in series assembly of seamless pad filters In accordance with the present invention, a method is described for making a low resistance-to-flow fluid filtration filter. The method comprises the steps of:

i) providing a plurality of sheets of fluid filtration media, each of said sheets having an upper surface and a lower surface and comprising a center point, a central zone, a shaped perimeter and an intermediate zone, said center point being located within said central zone and said central zone being located within said intermediate zone, said shaped perimeter of each of said sheets defining the outer edge of its respective sheet of filtration media; each of said sheets further comprising a folding zone, said folding zone surrounding said central zone and being surrounded by said intermediate zone, ii) forming, in each of said sheets, a plurality of primary folds within said folding zone, each of said primary folds being formed around an axis the projection of which lies within said folding zone and forms a fold line which is spaced apart from said center point, said plurality of primary folds, so formed a) creates a plurality of fold lines which, as connecting segments beginning and ending at the same point, define a seamless pad-type filter outer perimeter and b) forms a plurality of positive and negative secondary creases, said secondary creases being formed around a plurality of positive and negative crease lines, respectively, said crease lines being inclined to said fold lines, said plurality of fold lines forming pluralities of positive and negative crease lines, said crease lines shaping said shaped perimeter of each of said sheets of filtration media into pleats, said pleats forming a primary flow aperture in each of said sheets formed in accordance with this step, iii) sealing, in each of said sheets, said pleats so formed in accordance with step ii, such that a fluid passing through a primary flow aperture passes only through at least one of the central zone, the intermediate zone and the folding zone of said sheets, thereby creating a plurality of seamless pad-type filters, iv) setting aside one of said seamless pad-type filters as a final assembly filter, v) except for said final assembly filter, providing a pad-to-pad communication aperture in each of said seamless pad-type filters so formed in accordance with step ii, said communication aperture being located within said central zone, and vi) assembling said plurality of seamless pad-type filters by forming impermeable connection zone(s), said connection zones joining the communication aperture of a filter to the primary flow aperture of its immediately adjacent filter and such that said final assembly filter being the terminating end of assembled said plurality of seamless pad-type filters.

In accordance with the present invention, an in-series multi-compartment low resistance filter may be produced in accordance with the above described method. Such a multi-compartment filter is characterized in that it comprises an in-series-assembled plurality of seamless pad-type filters, each of said seamless pad-type filters being made as described earlier and characterized as described earlier. The multi-compartment filter is further characterized in that, except for a final assembly filter, all-in-series assembled seamless pad-type filters are provided with at least one pad-to-pad communication aperture and impermeable connection zone(s) said connection zones joining the communication aperture of a seamless pad type filter to the primary flow aperture of its immediately adjacent filter and such that said final assembly filter being the terminating end of said in-series assembled plurality of seamless pad-type filters.

The invention claimed is:

1. A method for making a low resistance-to-flow fluid filtration filter comprising the steps of:

i) providing a plurality of sheets of fluid filtration media, each of said sheets having an upper surface and a lower surface and comprising a center point, a central zone, a shaped perimeter and an intermediate zone, said center point being located within said central zone and said central zone being located within said intermediate zone, said shaped perimeter of each of said sheets defining the outer edge of its respective sheet of filtration media; each of said sheets further comprising a folding zone, said folding zone surrounding said central zone and being surrounded by said intermediate zone, ii) forming, in each of said sheets, a plurality of primary folds within said folding zone, each of said primary folds being formed around an axis the projection of which lies within said folding zone and forms a fold line which is spaced apart from said center point, said plurality of primary folds, so formed a) creates a plurality of fold lines which, as connecting segments beginning and ending at the same point, define a seamless pad-type filter outer perimeter and b) forms a plurality of positive and negative secondary creases, said secondary creases being formed around a plurality of positive and negative crease lines, respectively, said crease lines being inclined to said fold lines, said plurality of fold lines forming pluralities of positive and negative crease lines, said crease lines shaping said shaped perimeter of each of said sheets of filtration media into pleats, said pleats forming a primary flow aperture in each of said sheets formed in accordance with this step, iii) sealing, in each of said sheets, said pleats so formed in accordance with step ii, such that a fluid passing through a primary flow aperture passes only through at least one of the central zone, the intermediate zone and the folding zone of said sheets, thereby creating a plurality of seamless pad-type filters, iv) setting aside one of said seamless pad-type filters as a final assembly filter, v) except for said final assembly filter, providing a pad-to-pad communication aperture in each of said seamless pad-type filters so formed in accordance with step ii, said communication aperture being located within said central zone, and vi) assembling said plurality of seamless pad-type filters by forming impermeable connection zone(s), said connection zones joining the communication aperture of a filter to the primary flow aperture of its immediately adjacent filter and such that said final assembly filter being the terminating end of assembled said plurality of seamless pad-type filters.

* * * * *